US005687535A

United States Patent [19]

Rohlf

[11] Patent Number: 5,687,535

[45] Date of Patent: Nov. 18, 1997

[54] DETACHABLE ROOF ANCHOR

[75] Inventor: Bradley A. Rohlf, Red Wing, Minn.

[73] Assignee: D B Industries, Inc., Red Wing, Minn.

[21] Appl. No.: 552,629

[22] Filed: Nov. 3, 1995

[51] Int. Cl.[6] ..... E04B 1/38

[52] U.S. Cl. ..... 52/713; 52/27; 248/505

[58] Field of Search ..... 182/45; 248/228.1, 248/228.5, 237, 499, 505; 52/27, 37, 714, 713, 698

[56] References Cited

U.S. PATENT DOCUMENTS

| | | | |
|---|---|---|---|
| 2,703,688 | 3/1955 | Shuter | 248/237 |
| 3,237,717 | 3/1966 | Jackson | 182/3 |
| 3,269,679 | 8/1966 | Grappo | 248/72 |
| 3,408,780 | 11/1968 | Brister | 52/58 |
| 3,809,347 | 5/1974 | Pekarek | 248/48.1 |
| 3,853,202 | 12/1974 | Jarboe | 182/108 |
| 4,193,475 | 3/1980 | Sweet et al. | 182/8 |
| 4,226,058 | 10/1980 | Riley | 52/27 |
| 4,249,713 | 2/1981 | Glynn et al. | 248/237 |
| 4,317,418 | 3/1982 | Courshon, Jr. et al. | 110/331 |
| 4,581,863 | 4/1986 | Thaler | 52/126.2 |
| 4,584,813 | 4/1986 | Hudson | 52/744 |
| 4,595,165 | 6/1986 | Klingensmith et al. | 248/539 |
| 4,607,724 | 8/1986 | Hillberg | 182/3 |
| 4,666,131 | 5/1987 | Kettelkamp, Sr. et al. | 256/59 |
| 4,695,211 | 9/1987 | Van Iperen et al. | 248/505 |
| 4,852,692 | 8/1989 | Flaherty | 182/231 |
| 4,932,185 | 6/1990 | Lebel | 52/37 |
| 4,941,547 | 7/1990 | Livick | 182/107 |
| 4,957,185 | 9/1990 | Courchesne et al. | 182/150 |
| 5,011,106 | 4/1991 | Cody | 182/45 |
| 5,036,949 | 8/1991 | Crocker et al. | 182/3 |
| 5,054,576 | 10/1991 | Glynn | 182/3 |
| 5,067,586 | 11/1991 | Myers | 182/45 |
| 5,137,112 | 8/1992 | Nichols | 182/3 |
| 5,143,170 | 9/1992 | Hunt et al. | 182/3 |
| 5,143,171 | 9/1992 | Glynn et al. | 248/237 |
| 5,361,558 | 11/1994 | Thornton et al. | 52/698 |
| 5,370,202 | 12/1994 | Nichols | 248/237 |

*Primary Examiner*—Michael Safavi
*Attorney, Agent, or Firm*—Moore & Hansen

[57] ABSTRACT

A detachable roof anchor having a fixed, permanent portion and a removable, reusable portion. The permanent portion includes a roof anchor base plate, two carriage bolts and a truss clamp having serrated edges that engage the bottom side of the roof rafter. Releasably attachable to the permanent portion is a pivoting D-ring attachment member held in place by a clamp plate bolted to the roof anchor base plate. The attachment member, while providing safe and secure attachment of fall protection devices, also permits a wide range of motion without compromising the safety of the worker on the roof.

34 Claims, 3 Drawing Sheets

DETACHABLE ROOF ANCHOR

BACKGROUND OF THE INVENTION

1. Technical Field

The present invention relates generally to safety devices for protecting workers doing construction or repair on a building roof, especially a roof having an angle. In particular, the invention relates to devices known as roof anchors having a portion permanently fastened to a roof, with a reusable portion releasably attached to the permanent portion, and to which a safety line or other device, connected to a worker, may be attached.

2. Background Information

Roof anchors have been developed to respond to the obvious need for some type of safety device to protect workers on angled roofs from falling and sustaining serious injury. Some of these roof anchors have been developed for temporary use, intended to be removed as repair or construction of the roof is completed. However, there are also permanent roof anchors intended to become a fixture on the roof, available for later use upon the occasion of subsequent maintenance or repairs.

Most prior devices comprise complete safety assemblies, including safety lines or cables, line retraction devices, etc. However, many of the components of these systems perform functions that are redundant with other safety devices already on the market that may be easily adapted to use with a simple anchor device. Additionally, some prior art devices are small so as to be inexpensive, but these devices also have small openings for attachment of a snap hook or similar device for attaching a safety line. However, because of the constant motion of the person working on the roof, the snap hook tends to twist and turn in the opening of the anchor device, and small anchor devices with small openings more easily inadvertently release the snap hook, resulting in an unsafe condition where no fall prevention is provided by the anchor device.

For example, U.S. Pat. No. 5,370,202, issued to Nichols on Dec. 6, 1994, discloses a roof anchor, attachable to a rafter, comprised of a sheet metal strap folded over on itself in a manner that leaves a projecting portion exposed above the roofline. However, after the roofing work is completed, the unsightly projecting portion remains permanently exposed. Further, the attachment portion is fixed in a stationary position, and does not bend or move to accommodate the repositioning of a worker on the roof connected to the anchor via a lifeline.

Other, more simple devices are also available, but offer limited functionality. U.S. Pat. No. 5,137,112, issued to Nichols on Aug. 11, 1992, discloses a two pronged "staple" that may be driven part way into a structural element of the roof. When the job is finished, it may be driven completely into the roof, or bent over to be covered by shingles. However, the staple, the small size of which renders it convenient for certain applications, is limited by its size in the number of devices that may be attached to it and the ease with which devices may be attached to it.

U.S. Pat. No. 4,249,713, issued to Glynn et al. on Feb. 10, 1981, discloses a simple anchor that may be attached to the peak of an unfinished roof. It provides an opening to which a snap hook may be attached, and at the end of the roofing job, the projecting portion may be flattened against the roof with a hammer to be covered by shingles. However, the range of motion comfortably permitted to the worker attached to the anchor is limited somewhat, to reduce the likelihood that the snap hook will become disengaged from the anchor. Further, this anchor does not disclose a use or adaptation on other portions of the roof than the peak.

The detachable roof anchor of the present invention overcomes difficulties described above and affords other features and advantages heretofore not available.

SUMMARY OF THE INVENTION

The preferred embodiment of the present invention includes a permanent portion fixedly attached to a rafter, and a removable portion positioned above and releasably attached to the permanent portion. The permanent portion includes a roof anchor base plate, two carriage bolts and a truss clamp having serrated edges that engage the bottom side of the roof rafter. Releasably attachable to the permanent portion is a pivoting D-ring attachment member held in place by a clamp plate bolted to the roof anchor base plate.

The attachment portion of the detachable roof anchor is relatively large and defines at least a semicircle, for easy and secure attachment of snap hooks or other attachment devices, and is made of heavy gauge steel. The attachment member, while providing safe and secure attachment of fall protection devices, also permits a wide range of motion without compromising the safety of the worker on the roof.

It is an object of this invention to provide a safety device for the protection of workers doing jobs on angled, elevated surfaces such as roofs. It is also an object of this invention that the safety device should be sturdy and secure, capable of handling workers of all sizes, wearing any amount of necessary safety gear and tools. It is a further object of this invention to provide a safety device that will lessen the risk of a snap hook or carabiner becoming detached therefrom during use. It is a further object of this invention that the exposed, attachment portion of the roof anchor should be removable upon completion of a roofing job. It is a further object of the invention that the removable attachment portion of the roof anchor, if properly used and maintained, should be reusable.

Other objects and advantages of the invention will become apparent from the following detailed description and from the appended drawings in which like numbers have been used to describe like parts throughout the several views.

BRIEF DESCRIPTION OF THE DRAWINGS

FIG. 3 is a front elevation of the detachable roof anchor attached to a roof rafter;

DESCRIPTION OF THE PREFERRED EMBODIMENT

Figure 4:
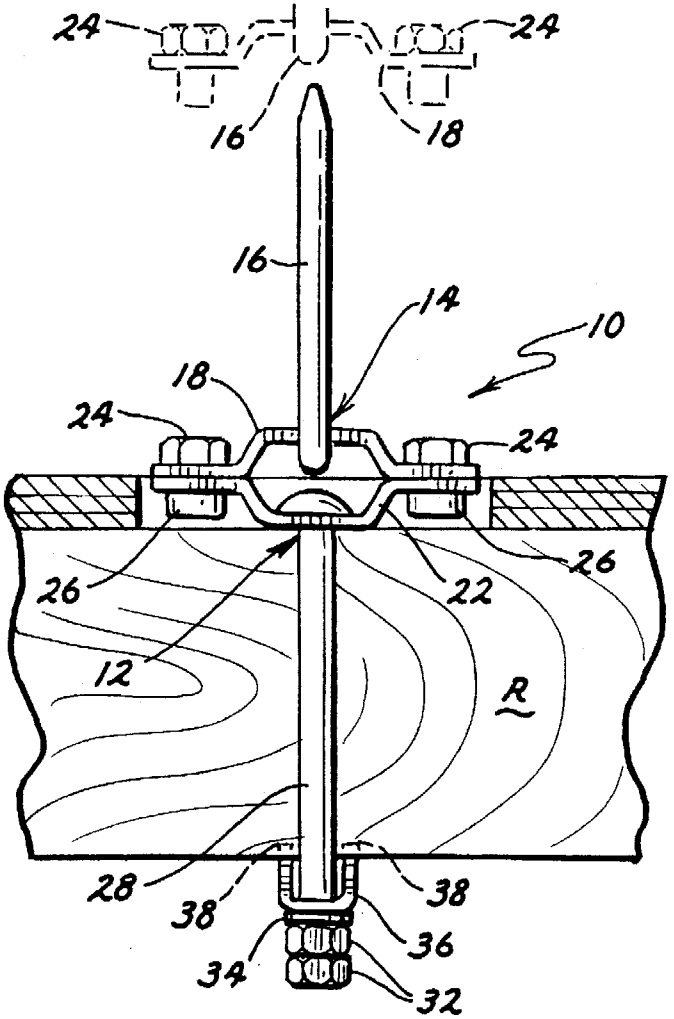
FIG. 4 is a side elevation of the detachable roof anchor illustrated in FIG. 3, also showing a phantom illustration of the detachable portion.
Figure 9:
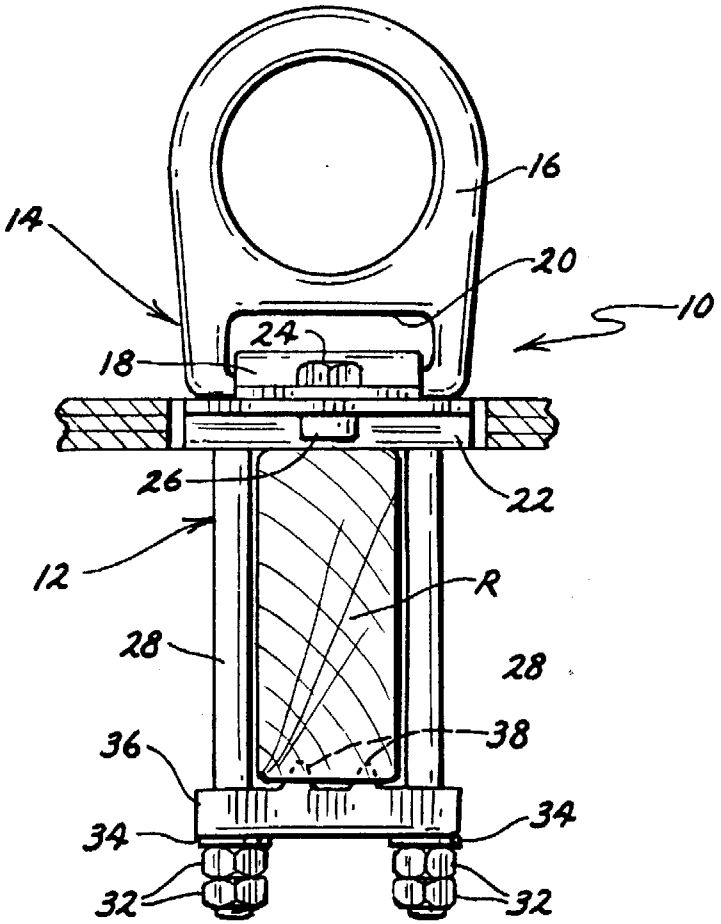
Figure 5:
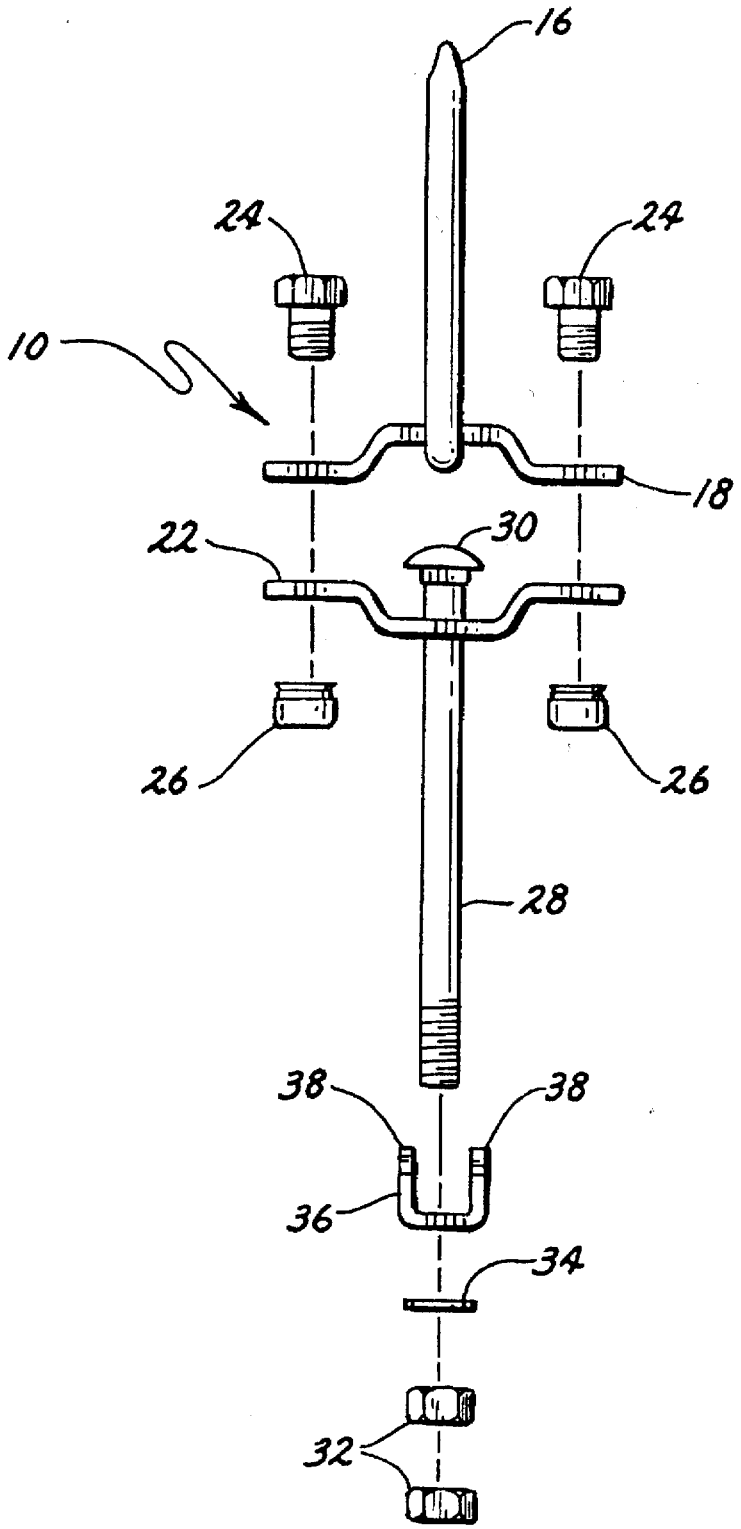
FIG. 5 is a side elevational exploded view of the detachable roof anchor.

With reference to the drawings, and in particular to FIGS. 3 and 4, the detachable roof anchor is generally indicated by reference numeral 10. Detachable roof anchor 10 includes a permanent portion 12 and a reusable, detachable portion 14. Pivotally attached to detachable portion 14 is an attachment member, preferably in the form of a D-ring 16, for attachment of a safety device such as a snap hook with a lifeline connected thereto.

In addition to D-ring 16, detachable portion 14 includes a clamp plate 18, which passes through a slot 20 in D-ring 16. Clamp plate 18 is releasably attachable to a roof anchor base plate 22, which forms the upper surface of permanent portion 12. Clamp plate 18 attaches to base plate 22 with two bolts 24 and corresponding self-clinching nuts 26.

Permanent portion 12 also includes two carriage bolts 28 that are positioned on either side of and adjacent to the rafter R (FIGS. 3 and 4). Carriage bolts 28 have preferably square necks 30, and are positioned in openings in base plate 22 (not shown) of corresponding configuration to prevent rotation of the carriage bolts 28 when nuts 32 are tightened thereto. Nuts 32 and washers 34 are attached to the threaded portion of carriage bolts 28 and bear against truss clamp 36, preferably having serrated edges 38. The serrated edges 38 of truss clamp 36 bear against and engage the lower surface of rafter R, as shown in FIGS. 3 and 4, to help ensure secure engagement of the permanent portion 12 of detachable roof anchor 10 with rafter R.

Figure 1:
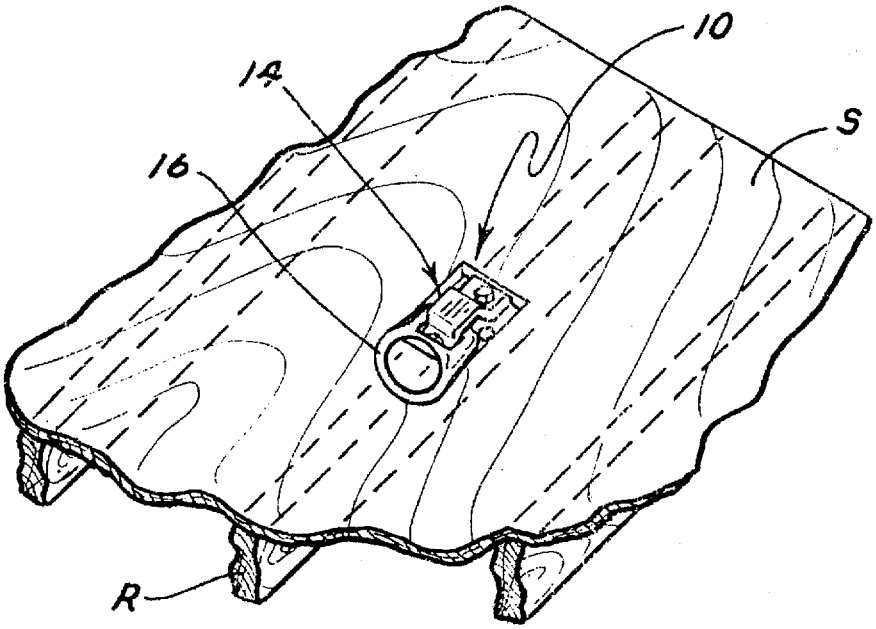
FIG. 1 is a perspective view of the detachable roof anchor of the present invention in position on a roof.
Figure 2:
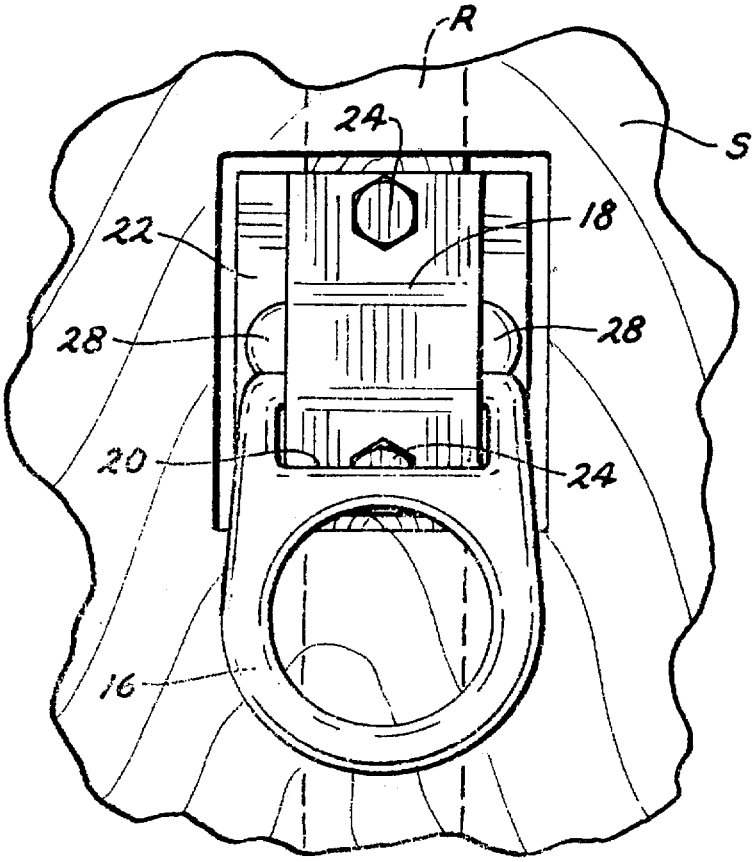
FIG. 2 is a top elevation of the detachable roof anchor in position on a roof.

In use, a square slot is cut in the roof sheathing S to allow detachable roof anchor 10 to sit on top of rafter R (FIGS. 1 and 2). Permanent portion 12 is secured to rafter R, making sure that the serrated edges 38 of truss clamp 36 are securely embedded into the bottom side of rafter R. Detachable portion 14 is then attached to permanent portion 12, using bolts 24 and self-clinching nuts 26. D-ring 16 is now pivotally positioned between base plate 22 and clamp plate 18. After use, detachable portion 14 may be removed, and roofing shingles are positioned over sheathing S and permanent portion 12. If desired, detachable portion 14 may then be reused with other permanent portions 12 on other roofing jobs. Similarly, if the shingles overlying sheathing S and permanent portion 12 are removed, permanent portion 12 may also be reused with another detachable portion 14.

While the preferred embodiments of the invention have been described, it should be understood that various changes, adaptations and modifications may be made therein without departing from the spirit of the invention and the scope of the appended claims.

What is claimed is:

1. A roof anchor to which may be attached a fall protection device for providing fall protection to workers located on a roof, the roof having a support structure including a rafter having a top, a bottom and two opposing sides, the roof anchor being attachable to the rafter, the roof also including a roof base having an upper surface for attachment of shingles thereto the roof base being fastened to a plurality of rafters, the roof anchor comprising:

a permanent roof anchor portion fixedly attached to the roof rafter, said permanent roof anchor portion extending generally downwardly from the upper surface of the roof base;

a detachable roof anchor portion releasably attached to said permanent roof anchor portion to which the fall protection device may be releasably attached said detachable roof anchor portion extending generally upwardly from the upper surface of the roof base; and releasable attachment means for releasably attaching said detachable roof anchor portion to said permanent roof anchor portion while said permanent; roof anchor portion remains fixedly attached to the roof rafter.

2. The detachable roof anchor described in claim 1, wherein said permanent roof anchor portion comprises:

first and second leg members, both said leg members extending along the opposite sides of the roof rafter, said first and second leg members both having a proximal end and a distal end;

first retaining means for retaining said proximal ends of said first and second leg members a fixed distance one from another, said first retaining means bearing against the top of the roof rafter; and second retaining means for retaining said distal ends of said first and second leg members a fixed distance one from another, said second retaining means bearing against the bottom side of the roof rafter.

3. The detachable roof anchor described in claim 2, wherein said permanent roof anchor portion further comprises:

securing means for firmly securing said second retaining means in position bearing against the bottom of the roof rafter.

4. The detachable roof anchor described in claim 3, wherein said first retaining means comprises:

a roof anchor base plate having first engaging means for engaging said releasable attachment means and second engaging means for engaging said first and second leg members.

5. The detachable roof anchor described in claim 4, wherein said roof anchor base plate further comprises:

a channel portion, said channel portion having a first side and a second side, said channel portion including said second engaging means for engaging said first and second leg members; and first and second tab portions projecting from said first and second sides, respectively, of said channel portion, said first and second tab portions including said tint engaging means for engaging said releasable attachment means.

6. The detachable roof anchor described in claim 5, wherein said second engaging means of said channel portion comprises:

first and second apertures engageable with said proximal ends of said first and second leg members respectively.

7. The detachable roof anchor described in claim 5, wherein said first engaging means of said first and second tab portions comprises:

at least on aperture in each of said first and second tab portions, respectively, engageable with said releasable attachable means.

8. The detachable roof anchor described in claim 7, wherein said releasable attachment means comprises:

a plurality of threaded bolts engageable with said detachable roof anchor portion and said apertures of said first and second tab portions; and a plurality of nuts threadedly engageable with said threaded bolts for securely retaining said threaded bolts in said apertures.

9. The detachable roof anchor described in claim 5, wherein said second retaining means comprises:

a clamp member having at least one serrated edge engageable with the bottom surface of the roof rafter for securely positioning the roof anchor, said clamp member also having engaging means for engaging said first and second leg members.

10. The detachable roof anchor described in claim 9, wherein said second retaining means further comprises:

first and second serrated edges engageable with the bottom surface of the roof rafter.

11. The detachable roof anchor described in claim 9, wherein said engaging means of said second retaining means further comprises:

first and second apertures engageable with said distal ends of said first and second leg members, respectively.

12. The detachable roof anchor described in claim 11, wherein:

said first and second leg members are bolts having threaded portions on said distal ends thereof; and said securing means includes first and second nut members threadedly engageable with said threaded portions of said first and second leg members, respectively.

13. The detachable roof anchor described in claim 1, wherein said detachable roof anchor portion comprises:

a detachable clamp member releasably attachable to said permanent roof anchor portion using said releasable attachment means; and fastening means retained between said detachable clamp member and said permanent roof anchor portion, to which fastening means the fall protection device may be releasably fastened.

14. The detachable roof anchor described in claim 13, wherein said detachable clamp member comprises:

a channel portion, said channel portion having a first side and a second side; and first and second tab portions projecting from said first and second sides, respectively, of said channel portion, said first and second tab portions including engaging means for engaging said releasable attachment means.

15. The detachable roof anchor described in claim 14, wherein said engaging means of said first and second tab portions comprises:

at least aperture in each of said first and second tab portions, respectively, engageable with said releasable attachment means.

16. The detachable roof anchor described in claim 14, wherein said fastening means retained between said detachable clamp member and said permanent roof anchor portion comprises:

a D-ring pivotally retained within said channel portion defined by said detachable clamp member.

17. A roof anchor having a detachable portion to which may be attached a fall protection device for providing fall protection to workers located on a roof, the roof having a support structure including a rafter having a top, a bottom and two opposing sides, the roof anchor being attachable to the rafter the roof also including a roof base for attachment of shingles thereto the roof base being fastened to a plurality of rafters, the roof anchor comprising:

a roof anchor base plate having first and second sides and a bottom side, said bottom side of said base plate bearing against the top side of the roof rafter, said base plate including first engaging means between said first and second sides thereof;

first and second tab portions projecting from said first and second sides, respectively, of said roof anchor base plate, said first and second tab portions both including second engaging means;

first and second leg members, both said leg members extending along the opposite sides of the roof rafter, said first and second leg members both having a proximal end and a distal end, said proximal ends of said first and second leg members being attached to said first engaging means of said base plate;

a clamp member having at least one serrated edge engageable with the bottom surface of the roof rafter for securely positioning the roof anchor, said clamp member including first and second apertures engageable with said distal ends of said first and second leg members, respectively; securing means for firmly securing said clamp member in position bearing against the bottom of the roof rafter;

a detachable clamp plate releasably attachable to said roof anchor base plate, said detachable clamp plate having first and second sides;

third and fourth tab portions projecting from said first and second sides, respectively, of said detachable clamp plate, said third and fourth tab portions both including third engaging means;

releasable attachment means for releasably attaching said detachable clamp plate to said roof anchor base plate, said releasable attachment means engaging said second engaging means of said first and second tab portions and said third engaging means of said third and fourth tab portions;

channel formed between said roof anchor base plate and said detachable clamp plate; and fastening means pivotally retained in said channel to which fastening, means the fall protection device may be releasably fastened.

18. The detachable roof anchor described in claim 17, wherein said fastening means pivotally retained in said channel comprises a D-ring.

19. The detachable roof anchor described in claim 17, wherein:

said first and second leg members are bolts having threaded portions on said distal ends thereof; and said securing means includes first and second nut members threadedly engageable with said threaded portions of said first and second leg members, respectively.

20. A roof anchor to which may be attached a fall protection device for providing fall protection to workers located on a roof, the roof having a support structure including a rafter having a top, bottom, and two opposing sides, the roof anchor being attachable to the rafter, the roof also including a roof base having an upper surface for attachment of shingles thereto, the roof base being fastened to a plurality of rafters, the roof anchor comprising:

a permanent roof anchor portion fixedly attached to the roof rafter, said permanent roof anchor portion including a roof anchor base plate, said roof anchor base plate bearing against the top side of the rafter, said permanent roof anchor portion extending generally downwardly from the upper surface of the roof base;

a detachable roof anchor portion for releasable attachment of the fall protection device, said detachable roof anchor portion being releasably attached to said roof anchor base plate and extending generally upwardly from the upper surface of the roof base; and releasable attachment means for attaching said detachable roof anchor portion to, and detaching said detachable roof anchor portion from, first engaging means of said roof anchor base plate while said permanent roof anchor portion remains fixedly attached to the roof rafter.

21. The detachable roof anchor described in claim 20, wherein said permanent roof anchor portion further comprises:

first and second leg members downwardly depending from second engaging means of said roof anchor base plate, both said leg members extending along the opposite sides of the roof rafter, said first and second leg members both having a proximal end and a distal end, said proximal ends of said first and second leg members being engageable with said second engaging means of said roof anchor base plate; and retaining means for retaining said distal ends of said first and second leg members a fixed distance one from another, said retaining means bearing against the bottom side of the roof rafter.

22. The detachable roof anchor described in claim 21, wherein said permanent roof anchor portion further comprises:

securing means for firmly securing said retaining means in position bearing against the bottom of the roof rafter.

23. The detachable roof anchor described in claim 22, wherein said roof anchor base plate further comprises:

a channel portion, said channel portion having a first side and a second side, said channel portion including said second engaging means for engaging said first and second leg members; and first and second tab portions projecting from said first and second sides, respectively, of said channel portion, said first and second tab portions including said first engaging means for engaging said releasable attachment means.

24. The detachable roof anchor described in claim 23, wherein said second engaging means of said channel portion comprises:

first and second apertures engageable with said proximal ends of said first and second leg members, respectively.

25. The detachable roof anchor described in claim 23, wherein said first engaging means of said first and second tab portions comprises:

at least one aperture in each of said first and second tab portions, respectively, engageable with said releasable attachment means.

26. The detachable roof anchor described in claim 25, wherein said releasable attachment means comprises:

a plurality of threaded bolts engageable with said detachable roof anchor portion and said apertures of said first and second tab portions; and a plurality of nuts threadedly engageable with said threaded bolts for securely retaining said threaded bolts in said apertures.

27. The detachable roof anchor described in claim 23, wherein said second retaining means comprises:

a clamp member having at least one serrated edge engageable with the bottom surface of the roof rafter for securely positioning the roof anchor, said clamp member also having engaging means for engaging said first and second leg members.

28. The detachable roof anchor described in claim 27, wherein said second retaining means further comprises:

first and second serrated edges engageable with the bottom surface of the roof rafter.

29. The detachable roof anchor described in claim 27, wherein said engaging means of said second retaining means further comprises:

first and second apertures engageable with said distal ends of said first and second leg members, respectively.

30. The detachable roof anchor described in claim 29, wherein:

said first and second leg members are bolts having threaded portions on said distal ends thereof; and said securing means includes first and second nut members threadedly engageable with said threaded portions of said first and second leg members, respectively.

31. The detachable roof anchor described in claim 20, wherein said detachable roof anchor portion comprises:

a detachable clamp member releasably attachable to said first engaging means of said roof anchor base plate using said releasable attachment means; and fastening means retained between said detachable clamp member and said permanent roof anchor portion, to which said fastening means the fall protection device may be releasably fastened.

32. The detachable roof anchor described in claim 31, wherein said detachable clamp member comprises:

a channel portion, said channel portion having a first side and a second side; and first and second clamp tab portions projecting from said first and second sides, respectively, of said channel portion, said first and second clamp tab portions including second engaging means for engaging said releasable attachment means.

33. The detachable roof anchor described in claim 32, wherein said second engaging means of said first and second clamp tab portions comprises:

at least one aperture in said first and second clamp tab portions, respectively, engageable with said releasable attachment means.

34. The detachable roof anchor described in claim 32, wherein said fastening means retained between said detachable clamp member and said permanent roof anchor portion comprises:

a D-ring pivotally retained with said channel portion defined by said detachable clamp member.

* * * * *

UNITED STATES PATENT AND TRADEMARK OFFICE

CERTIFICATE OF CORRECTION

PATENT NO. : 5,687,535
DATED : November 18, 1997
INVENTOR(S) : Bradley A. Rohlf

It is certified that error appears in the above-identified patent and that said Letters Patent is hereby corrected as shown below:

Column 3, Line 64 after "permanent" please delete ";".

Column 4, Line 34 please delete "tint", and insert --first--.

Column 4, Line 45 after "least" please delete "on", and insert --one--.

Column 5, Line 33 after "least" please insert --one--.

Column 5, Line 48 after "rafter", please insert --,--.

Signed and Sealed this

Twenty-third Day of June, 1998

Bruce Lehman

*Attest:*

BRUCE LEHMAN

*Attesting Officer*

*Commissioner of Patents and Trademarks*